US005322194A

United States Patent [19]

Roberts

[11] Patent Number: 5,322,194

[45] Date of Patent: Jun. 21, 1994

[54] DISPENSER FOR COLLAPSIBLE TUBES

[76] Inventor: Allen L. Roberts, c/o Kathy Coleman, 1700 Broadway, Suite 1800, Denver, Colo. 80290

[21] Appl. No.: 924,523

[22] Filed: Aug. 4, 1992

[51] Int. Cl.[5] ..... B65D 35/28

[52] U.S. Cl. ..... 222/103; 222/105

[58] Field of Search ..... 222/103, 105, 92

[56] References Cited

U.S. PATENT DOCUMENTS

| | | | |
|---|---|---|---|
| 2,638,250 | 5/1952 | Houldsworth | 222/95 |
| 2,759,636 | 8/1956 | Albert et al. | 222/103 |
| 2,795,356 | 6/1957 | Tschurny | 222/95 |
| 3,291,345 | 12/1966 | McCombs | 222/103 |
| 3,675,822 | 7/1972 | Casali et al. | 222/103 |
| 3,768,699 | 10/1973 | Robe, Jr. | 222/103 |
| 3,974,943 | 8/1976 | Wilston | 222/103 |
| 4,019,656 | 4/1977 | Spears | 222/103 |
| 4,213,543 | 7/1980 | Thiern | 222/103 |
| 4,326,647 | 5/1980 | Pool | 222/103 |
| 4,424,917 | 1/1984 | Berger et al. | 222/103 |
| 4,565,303 | 1/1986 | Gilbertson | 222/103 |
| 4,722,457 | 2/1988 | Bedwell et al. | 222/103 |
| 5,105,984 | 4/1992 | Kazimir | 222/103 |
| 5,145,093 | 9/1992 | Zeller | 222/103 |

FOREIGN PATENT DOCUMENTS

| | | | |
|---|---|---|---|
| 557712 | 2/1957 | Italy | 222/103 |

*Primary Examiner*—Andres Kashnikow
*Assistant Examiner*—Philippe Derakshani
*Attorney, Agent, or Firm*—Gregg I. Anderson; Carol W. Burton

[57] ABSTRACT

A device suitable for holding a collapsible tube and dispensing the contents thereof is provided. The device has a base which supports and holds the tube, an upper plate pivotally attached to the base and adapted to pivot or rotate one or more times towards said base to compress the collapsible tube and dispense the contents thereof. The device also includes a forward wall having a vertically disposed slot which receives the neck of the collapsible tube and allows the tube to slide vertically as the tube is compressed and the contents are dispensed. Repeated rotations of the upper plate results in a milking of the contents of the tube and thus a controlled dispensing of the contents.

6 Claims, 2 Drawing Sheets

DISPENSER FOR COLLAPSIBLE TUBES

BACKGROUND OF THE INVENTION

1. Field of the Invention

The present invention relates to a device for squeezing a collapsible tube to dispense the contents thereof. More particularly, the present invention relates to a lever action device for receiving a collapsible tube containing dispensable contents and by actuating the lever controllably dispensing a portion of the contents of the tube.

2. Prior Art

Semi-solid flowable substances have long been packaged in collapsible tubes made of metal or plastic. Such tubes are designed to be squeezed to express in a controlled manner the tube contents. Collapsible tubes are used to dispense products found in the home, such as toothpaste, shampoo and other hair care products, lotions, foods and cleaning products. Such tubes are also utilized in hospitals, clinics and laboratories to dispense medicines, salves and other materials. Similarly, for industrial use collapsible tubes are utilized to dispense greases, caulking, grouting and the like.

Often, only a small portion of the contents of a collapsible tube is dispensed at any one time. Moreover, due to irregular use of a collapsible tube, the contents are often dispensed unevenly and amounts of undispensed materials can be left in the container. As the contents are discharged, the remaining undispensed materials are especially difficult for children and elderly people to dispense.

OBJECTS OF THE INVENTION

It is the principal object of the present invention to provide an improved dispenser suitable for holding a collapsible tube of dispensable material.

It is another object of the present invention to provide an improved dispensing device for holding a collapsible tube and dispensing the contents thereof easily and completely.

It is another object of the present invention to provide a collapsible tube dispenser of the foregoing character for holding a tube and dispensing the contents thereof in a sanitary manner.

It is still a further object of the present invention to provide an improved holder and dispenser for a collapsible tube, which dispenser is inexpensive, rugged and suitable for mounting in either a horizontal or vertical position.

SUMMARY OF THE INVENTION

The present invention is embodied in a dispenser for holding a collapsible tube and dispensing the contents thereof. The dispenser includes a base which supports and retains a collapsible tube of dispensable contents, an upper plate or tongue pivotally attached to the base and adapted to be pivoted or rotated one or more times towards the base to compress the collapsible tube and dispense the contents thereof in a controlled manner. The dispenser is further provided with a forward wall having a vertically disposed slot therethrough which receives and retains the neck of the collapsible tube and allows the tube neck to slide or move vertically as the contents of the tube are dispensed so that repeated rotation of the upper plate or tongue results in a milking of the contents and thus a controlled dispensing of the contents through the tube neck.

Means are provided for fastening the device to a surface. For example, an adhesive material is desirably applied to the underside of the base so that the dispenser may be attached to a horizontal or a vertical surface.

DESCRIPTION OF THE PREFERRED EMBODIMENT

Figure 1:
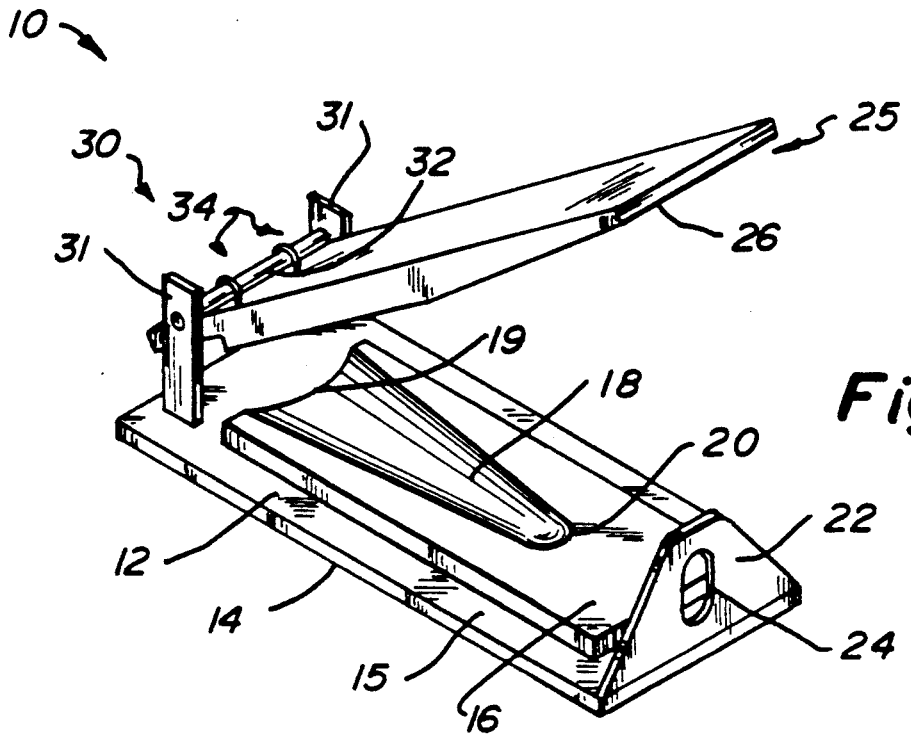
FIG. 1 is a perspective view of a dispenser and holder for a collapsible tube.
Figure 2:
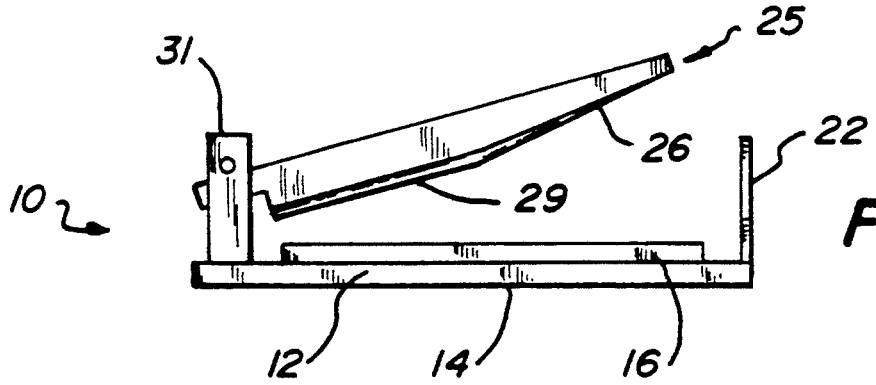
FIG. 2 is a vertical side elevation view of the dispenser shown in FIG. 1.
Figure 3:
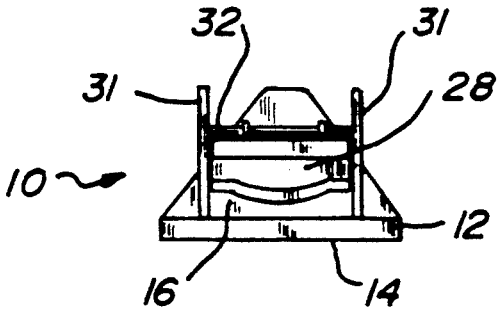
FIG. 3 is a rear elevation view of the dispenser shown in FIG. 2.
Figure 4:
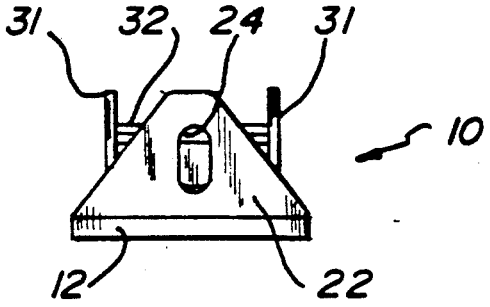
FIG. 4 is a front elevation view of the dispenser shown in FIG. 2.
Figure 5:
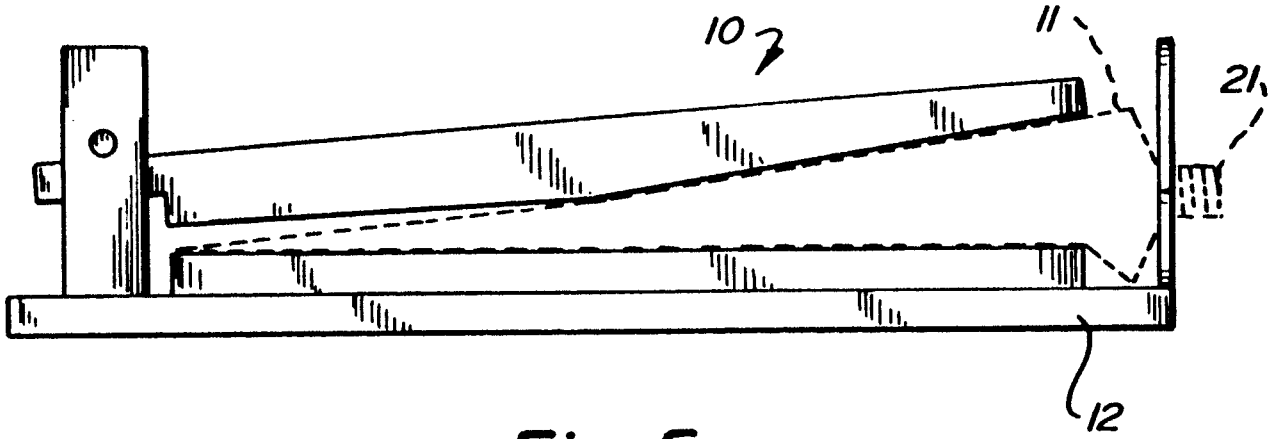
FIG. 5 is a side elevation view similar to FIG. 2 but showing a relatively full collapsible tube positioned in the dispenser.
Figure 6:
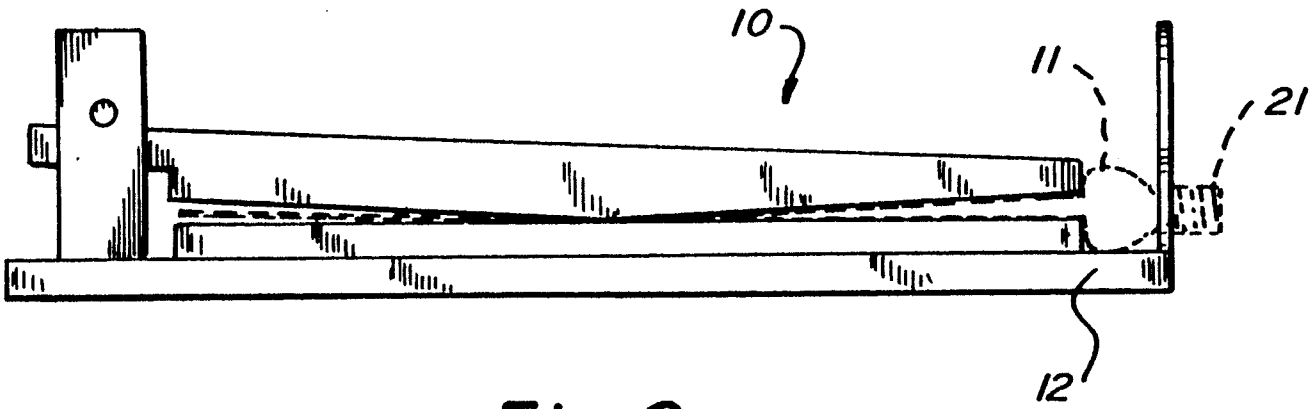
FIG. 6 is a side elevation view similar to FIG. 6 but showing the tube contents substantially discharged.

In accordance with the present invention a dispenser device 10 is adapted to hold a collapsible tube 11 containing toothpaste, shampoo, medicine, grease or other viscous liquid or semi-solid liquid, as shown in the drawings. The dispenser device 10 comprises an elongated base 12 having a planar undersurface 14 positionable on a horizontal surface. The dispenser device may alternatively be attached to a horizontal or vertical surface by appropriate fasteners such as screws, nails or pressure-sensitive adhesives.

For receiving and supporting a collapsible tube, the base 12 includes on its upper surface 15 a raised squeezing panel 16. The squeezing panel 16 and the base 12 may be formed as an integral structure or be made from separate pieces secured together.

For receiving and retaining the collapsible tube, the squeezing plate 16 defines a generally U-shaped tapered concave recess 18. The recess 18 opens into one end of the squeezing plate 16 to define a concave recessed opening 19. At its opposite end, the recess 18 defines a shallow narrow apex 20 positioned adjacent to but spaced from the opposite end of the squeezing plate 16.

For receiving the neck 21 of a collapsible tube 11 and retaining the neck and tube while allowing the neck to move vertically, an end panel 22 extends upwardly from the base plate 12 and defines a vertically elongated slot 24 for receiving the tube neck 21. The end panel 22 supports the tube in the dispensing device when the device is mounted vertically on a wall or other vertical surface such as a cabinet panel.

For cooperating with the base plate to squeeze an interposed flexible tubular collapsible container positioned thereon in the concave recess 18, a tongue 25 is pivotally mounted to the end of the base plate 12 opposite from the wall 22. The tongue is swingable away from or towards the base plate to provide a clamping or squeezing action for dispensing the contents of the tube.

For engaging the surface of the tube, the undersurface 26 of the tongue 25 includes a tapered U-shaped boss 28 corresponding dimensionally with the tapered U-shaped concave groove 18 in the base squeezing plate 16. The squeezing boss 28 cooperates with the squeezing groove 18 to effect an efficient dispensing of the tube contents as the tongue 25 is pushed towards the base plate 12. The undersurface of the tongue 26 is defined as either a convex transversely shallow V-shaped or arcuate configuration. This configuration forms a transverse peak 29 at approximately the midpoint of the U-shaped concave groove 18 and U-shaped convex boss or projection 28. This peak or curvature substantially enhances the discharge of the collapsible tube contents by providing a milking action as the tongue is successively pushed against or pulled away from the collapsible tube.

For pivotally mounting the tongue 25 on the base 12, any appropriate pivot mechanism at the juxtaposed ends of the tongue and base may be utilized. In the modifications shown in the drawings, the pivot structure 30 is formed by a pair of spaced elongated supports 31 extending outwardly and generally perpendicular to the upper surface of the base plate 12. A pivot rod 32 extends between the outer ends of the supports 31 generally parallel to the surface of the base plate 12. The tongue 25 is pivotally secured to the rod 32 by a pair of spaced apart eyelets or brackets 34 on its upper surface surrounding or engaging the rod 32 in pivotal relationship therewith. The upper surface of the tongue 25 further engages the rod to provide together with the brackets or eyelets a pivot joint or hinge 30. If desired, spacers 35 may be provided between the pivot brackets 34 and the supports 31.

In operation, the tongue 25 is pivoted away from the base 12 to provide a generally V-shaped opening into which a collapsible tube of dispensable contents is inserted. In this process, the cap is removed from the end of the tube, and the neck inserted in the slot 24 in the end wall and the cap replaced. The tube nests in the concave recess in the lower base plate, and the tongue is applied to the upper surface of the tube. When it is desired to dispense the contents of the tube, the cap is removed and a gentle pressure on the tongue expels a portion of the tube contents. That portion is removed and the cap replaced. As the tube contents are discharged, the tongue moves closer to the tube and the tapered or arcuate lower surface of the tongue effects an efficient removal of the tube contents by a generally milking action. As the tube collapses, the convex projection on the lower surface of the tongue tends to force the tube into the recess in the upper surface of the squeezing plate 16 thereby further effecting substantially complete discharge of the tube contents.

While a certain illustrative embodiment of the present invention has been shown in the drawings and described above in considerable detail, it should be understood that there is no intention to limit the invention to the specific form disclosed. On the contrary, the intention is to cover all modifications, alternatives, equivalents and uses falling with the spirit and scope of the invention as expressed in the appended claims.

What is claimed is:

1. A dispenser for holding a collapsible tube containing an extrudable substance and having a closure receivable neck defining a dispensing opening through which said substance is dischargeable, said dispenser comprising:

an elongated base plate having a raised elongated squeezing plate with opposing first and second ends thereon, said squeezing plate defining a horizontally U-shaped vertically concave recess having a concave recessed opening at the second squeezing plate end and an apex positioned adjacent to but spaced from the from the first plate squeezing end adapted to receive said tube;

a wall on said base plate extending from the first squeezing plate end perpendicular to said base plate and defining an elongated slot extending generally normal to said base plate for slidably receiving the neck of said tube;

a squeezing tongue juxtaposed on said base plate for engaging the side of said tube opposite said base plate, said tongue having an undersurface in which is formed a tapered U-shaped boss having a transverse peak;

means hinging said tongue to said base plate at the second squeezing plate end, whereby said tongue rotatably overlies said squeezing plate;

said U-shaped boss on the surface of said tongue facing said squeezing plate and corresponding in configuration to said concave squeezing plate recess, and boss being receivable in said concave squeezing plate recess when said tongue is rotated toward said base plate with a portion of the tube positioned therebetween as said tube contents are discharged, said squeezing tongue and boss defining a generally shallow, convex longitudinal arcuate surface configuration whereby when said tongue is rotated about said hinge toward said base plate said collapsible tube is squeezed with a milking action to effect a substantially complete discharge of said substance from said tube.

2. A dispenser as defined in claim 1 wherein said hinging means comprises a pair of elongated supports extending vertically and perpendicularly from said elongated base at the second squeezing plate end, a pivot rod extending between said elongated supports, and means for receiving said pivot rod proximate to said tongue.

3. A dispenser as defined in claim 2 wherein said pivot rod receiving means comprises a plurality of eyelets attached to said tongue.

4. A dispenser as defined in claim 1 wherein said raised elongated squeezing plate and said elongated base plate are formed as an integral structure.

5. A dispenser as defined in claim 2 wherein said raised elongated squeezing plate is formed integrally with said elongated base plate.

6. A dispenser as defined in claim 3 wherein said raised elongated squeezing plate is formed integrally with said elongated base plate.

* * * * *